US007481001B1

(12) United States Patent
Rao

(10) Patent No.: US 7,481,001 B1
(45) Date of Patent: Jan. 27, 2009

(54) ROLLING T-SQUARE DRYWALL CUTTER

(76) Inventor: Gary P. Rao, 181 S. Conger Ave., Conger, NY (US) 10920

( * ) Notice: Subject to any disclaimer, the term of this patent is extended or adjusted under 35 U.S.C. 154(b) by 13 days.

(21) Appl. No.: 11/818,275

(22) Filed: Jun. 14, 2007

(51) Int. Cl.
*B43L 13/02* (2006.01)
*B43L 7/02* (2006.01)

(52) U.S. Cl. ..... 33/42; 33/479

(58) Field of Classification Search ..... 33/42, 33/43, 44, 32.1, 32.2, 32.3, 32.5, 32.6, 479
See application file for complete search history.

(56) References Cited

U.S. PATENT DOCUMENTS 561,585 A * 6/1896 Harris ..... 33/41.4
1,792,393 A * 2/1931 Phillips ..... 33/42
2,529,210 A * 11/1950 Butler ..... 33/44
3,174,225 A * 3/1965 Abraham ..... 33/42
3,286,351 A * 11/1966 McAlister ..... 33/32.2
3,885,315 A * 5/1975 Polselli et al. ..... 33/42
4,956,919 A 9/1990 Granger
5,471,753 A 12/1995 Rodrigues
5,600,892 A 2/1997 Peugh
5,862,601 A * 1/1999 O'Brien et al. ..... 33/41.5
6,070,331 A 6/2000 Dempsey
6,629,370 B1 10/2003 Sposato
2001/0020334 A1* 9/2001 Wrobbel ..... 33/42
2006/0005404 A1* 1/2006 Adkins ..... 33/42

* cited by examiner

*Primary Examiner*—G. Bradley Bennett
(74) *Attorney, Agent, or Firm*—David J. Wilson

(57) ABSTRACT

The present invention relates to a device for easily and accurately scoring and cutting drywall sheet material, the device having a general appearance of a T-square and comprising rollers under the portion of the device that contacts the edge of the drywall sheet, a movable blade and blade holder and other features to aid the user in scoring and cutting drywall.

14 Claims, 5 Drawing Sheets

ROLLING T-SQUARE DRYWALL CUTTER

BACKGROUND OF INVENTION

Drywall is used in the construction of buildings. It is plasterboard made of gypsum and other ingredients and is sold in sheets of, typically, 4 feet by 8 feet. It is used for covering wall studs and is then covered with, for example, paint or wallpaper. Drywall needs to be sized to be used for most applications. Although drywall is easy to cut by scoring the drywall and then "snapping" the drywall at the score mark, it is often cumbersome to make properly measured straight score marks and breaks. This is because the tools used to permit the scoring and cutting of an eight foot piece of drywall must be just as long as the longest length of the drywall (i.e., eight feet) or the user must make score marks from both ends of the drywall and try to align the score marks. Such techniques are cumbersome because the tools presently available to workers do not permit the easy of use necessary for quick and accurate scoring and cutting of drywall. In addition, the tools presently available to workers in the field do not permit the easy repositioning of the tool when setting up to make the needed score marks and cuts. This leads to inaccuracy and wastes time.

Today, drywall is typically cut with a straight edge and a utility knife. Sometimes people use T-squares or other devices to help ensure that the score marks and breaks are straight. Others have designed devices to aid users in the scoring and cutting of drywall but these prior art solutions to this problem are not without significant problems of their own.

For example, U.S. Pat. No. 4,956,919 to Granger discloses a drywall T-square with perpendicular members that slide relative to each other and with slots cut into the long arm of the T-square for inserting a knife blade. The user must then slide the T-square across the top of the drywall or slide one arm of the T-square within the other arm while simultaneously maintaining the cutting edge of the knife perpendicular to the drywall sheet. As can be seen, this device makes the scoring and cutting of drywall both cumbersome and prone to error.

U.S. Pat. No. 5,600,892 to Peugh, et al., discloses a drywall cutter for simultaneously scoring on both sides of the plasterboard. The cutter has two long arms that must be slipped over the end of the drywall carefully and evenly to avoid breaking or damaging the drywall causing waste or necessitating repairs. Such manipulations are cumbersome and only serve to slow workers down.

U.S. Pat. No. 5,471,753 to Rodrigues discloses a T-square style drywall cutter with a sliding knife-edge. If the device is not placed in the correct location for cutting it must be moved across the top of the drywall sheet. This is not always easy to accomplish as the T-square will tend to drag on the drywall sheet requiring the user to lift the device off of the drywall sheet and replace it. This, of course, it time consuming for the user.

U.S. Pat. No. 6,070,331 to Dempsey discloses a T-square with tabs that work to keep the device from rocking as it is being used. The device, however, has the same problems as the device discussed directly above. That is, if it must be moved it will drag across the edge of the drywall requiring the user to lift the device off of the drywall sheet and replace it. This, of course, it time consuming for the user.

U.S. Pat. No. 6,629,370 to Sposato describes a T-square having a slidable knife and stabilizer tabs. The device, however, has the same problems as the devices discussed directly above. That is, if it must be moved it will drag across the edge of the drywall requiring the user to lift the device off of the drywall sheet and replace it. This, of course, it time consuming for the user. Additionally, the mechanism for holding the knife blade is complicated, cumbersome to use and prone to loosening during use.

Therefore, what is needed is a drywall cutter that solves these prior art problems. Namely, what is needed is a drywall cutter that moves across the edge of the drywall easily as well as having a slidable knife that is both easy to use and does not easily loosen during use.

SUMMARY OF INVENTION

In one aspect, the invention relates to a drywall cutter that solves the problems identified with the prior art devices. In one embodiment, the drywall cutter of the present invention is not limited to scoring and cutting drywall. For example, the device of the present invention may be used to score and/or cut other materials such as cardboard, poster board, plywood, sheet metal, etc. In this regard, the blade and blade holder of the present invention is removable and replaceable with, for example, a pen holder or marker holder (for holding a pen, pencil, marker or other writing utensil) as well as a heavier blade or other device that is useful for marking, scoring and cutting sheet material. One of skill in the art will understand which of the implements would be useful for the particular task being performed. However, by way of non-limiting illustration, a pencil or other marker, for example, may be useful to mark a cutting line on wood, metal or paper. A blade may be useful to score drywall or cut paper, etc.

Although the device of the present invention may be used for marking, scoring and cutting sheet materials other than drywall, it is ideal for scoring and cutting drywall. Drywall, also commonly known as gypsum board, plasterboard (UK, Ireland, Australia), gibraltar board or gib (New Zealand—GIB being a trademark of Winstone Wallboards), rock lath, sheetrock (a trademark of United States Gypsum Company), gyprock (Canada and Australia—likely a portmanteau of "gypsum board" and "sheetrock") or rigips (Eastern Europe—after the Rigips brand), is a common manufactured building material used globally for the finish construction of interior walls and ceilings.

A drywall panel is made of a paper liner wrapped around an inner core made primarily from gypsum plaster, the semi-hydrous form of calcium sulphate ($CaSO_4.\frac{1}{2}H_2O$). The plaster is mixed with fiber (typically paper and/or fiberglass), foaming agent, various additives that increase mildew and fire resistance, and water and is then formed by sandwiching a core of wet gypsum between two sheets of heavy paper or fiberglass mats. When the core sets and is dried, the sandwich becomes rigid and strong enough for use as a building material.

The device of the present invention, in one embodiment, has the general appearance of a T-square and is referred herein as a T-square device. The T-square device of the present invention has several features to aid the user and solve the problems identified with the prior art devices discussed above. First, the T-square device of the present invention comprises two straight members, the first straight member and the second straight member. In one embodiment, the first straight member comprises, essentially, a "U"-shaped appearance when viewed from in a cross sectional view thereby creating a flat side and a recessed side. The recessed side comprises a plurality of rollers that are at lease partly deposited into the recess. In a preferred embodiment, the rollers are recessed such that the axes on which they rotate are secured in the portions of the first straight member that form the sides of the "U" shape. Thus, in a preferred embodiment, about 60% of the roller is within the recess of the first straight member and about 40% of the roller extends beyond the recess of the first straight member such that the rollers may be caused to roll or rotate on their axes when the first straight member is drawn across a firm surface, for example.

One practiced in the art will realize that the rollers of the present invention may be recessed more or less than 60% so long as the rollers are free to rotate when in contact with a firm surface, for example, and the rollers are secured at least partially within the recess. Thus, the rollers of the present invention may extend beyond the recess of the first straight member by from approximately 5% to approximately 60%.

In one embodiment, the rollers of the present invention are spaced about 1 inch apart from each other. In another embodiment, the rollers are spaced from about ½ inch to 6 inches apart from each other. In yet another embodiment, the rollers are spaced between about 1 inch to 3 inches apart from each other.

In an other embodiment, the flat edge of the first straight member (i.e., the edge opposite the recess, may have markings or engravings on it such as, for example, measuring markings (e.g., standard or metric units) and/or other information that may be useful to one using the device (e.g., mathematical formulas, common conversion factors and/or firm logos).

The second straight member of the T-square device of the present invention comprises, in one embodiment, two edges wherein the edges have concave (or other shape) recesses essentially the length of the second straight member (see, e.g., FIG. 2). These recesses need not be deep and are, in a preferred embodiment, about ⅛ to ¼ inch deep. The recess are designed to allow a carrier or holder to slide essentially the length of the second straight member. The holder of the present invention will be discussed in greater detail below.

The second straight member of the present invention is fixedly attached to the first straight member to create a "T" shape for which the device is named. The second straight member of the device is attached to the first straight member at about mid way between the two ends of the first straight member. The second straight member is attached such that the axes of the rollers secured within the recess of the first straight member are perpendicular to the length of the second straight member and the rollers are oriented towards the second straight member. Thus, the T-square device of the present invention, when used to score and cut a piece of drywall, for example, is placed such that the first straight member rests on the edge of the drywall sheet material with the rollers in contact with the edge of the drywall sheet material and with the second straight member resting on a flat side of the drywall sheet material.

In one embodiment, when the second straight member of the T-square of the present invention is laying flat on the drywall (or other sheet material), the rollers are designed to rest on the edge of the drywall material. Thus, in one embodiment, it is contemplated that the second straight member of the present invention, when attached to the first straight member of the present invention, is positioned in a recess on the first straight member so that the rollers are positioned as close to the back side of the second straight member as possible (see, e.g., FIG. 4A). In another embodiment, the second straight member of the present invention is attached to the first straight member without being positioned in a recess of the first straight member (see, e.g., FIG. 4B). In both of these embodiments, the rollers extend out of the recess of the first straight member such that the non-roller parts of the first straight member do not touch the drywall (or other) sheet material and the T-square of the present invention may move (or roll) freely across the edge of the drywall (or other) sheet material.

In another embodiment, the flat edge of the second straight member (i.e., the edge that can be viewed by the user when placed on a sheet of drywall or other sheet material, may have markings or engravings on it, such as, for example, measuring markings (e.g., standard or metric units or other measurement marking such as distances between wall studs) or other information that may be useful to one using the device (e.g., mathematical formulas, common conversion factors and/or firm logos).

The T-square device of the present invention also comprises a holding device for holding, for example, a blade or other sharp cutting instrument. The blade may be, but need not be, contained in a handle or blade handle. In the present specification, blade and blade handle may be used interchangeably and refer to a cutting device mounted on the blade holder of the present invention. The holding device is attached to a slide that is positioned on the second straight member. The slide is made with ends that curve, curl or otherwise bend to create tabs such that the tabs engage the recesses in the edges of the second straight member (see, e.g., FIG. 2). The holding device is removable from the slide or integral with the slide. Other holding devices may be attached to the T-square device of the present invention by either attaching to the slide or by being placed such that the tabs engage the recesses of the second straight member. Other holding devices may, for example, hold pencils, pens, markers (or other writing utensils) or other items that may be useful for the user of the T-square device of to the present invention. The other holding devices that hold a writing utensil holds the writing utensil, in one embodiment, at an angle of between 45 and 90 degrees (i.e., perpendicular) as measured from the surface of the sheet material.

The T-square device of the present invention is not limited by size. In one embodiment, the second straight member of the T-square device of the present invention is from about 12 inches to 8 feet long. In a preferred embodiment, the second straight member of the T-square device of the present invention is from about 24 inches to 48 inches long. The first length straight member of the T-square device of the present invention is not limited by the length of the second straight member of the present invention. In a preferred embodiment, the length of the first straight member is from about 25% to about 75% of the length of the second straight member of the present invention.

The width of the second straight member of the present invention is about 1 inch to 6 inches. The width of the first straight member of the present invention is wide enough such that the rollers of the present invention are as wide or wider than a sheet of drywall. In a preferred embodiment the width of the first straight member is about ¾ inch to 1½ inches wide with the rollers comprising about 50%-75% of the width of the first straight member.

The present invention is not limited by the materials used to construct the device. In a preferred embodiment, the device comprises one or more of metal, plastic or wood.

In one embodiment of the present invention, the first straight member also comprises one or more tabs, stabilizers or stabilizing structures that help prevent the T-square of the present invention from rocking when being used. The stabilizers are located on the first straight member and are positioned to extend over the drywall or other sheet material and rest on the sheet material. In one embodiment, the stabilizers run the length of the first straight member, though they may be shorter. In another embodiment, the stabilizers extend about ½ inch to 2 inches over the sheet material.

The present invention also comprises a method of use wherein the T-square device of the present invention is positioned such that the rollers of the first straight member are resting on an edge of a sheet of drywall or other sheet material and the second straight member is resting on the flat surface of the sheet material. The blade holder (or other holder selected by the user) is then moved to the correct position on the second straight member by sliding the slide and attached holder along the second straight member until the correct position is achieved. In one embodiment, the holder and/or slide device may be secured in the desired position with, for example, a screw, wing nut of other device known in the art. The T-square device is then moved across the sheet material by rolling the first straight member across the edge of the sheet material and the blade (or marker, etc.) is drawn along the sheet material causing a score or other mark to be made on the sheet material. In the case of drywall, after the drywall is scored with the T-square device of the present invention, the drywall may be "snapped" apart (by, for example, bending the drywall) at the location of the score mark.

In one embodiment, the present invention contemplates a T-square device for aiding in the scoring and cutting of sheet material, comprising: a first straight member having essentially a "U" shape when viewed in cross section, the "U" shape giving the first member a recessed area, a plurality of rollers, each roller comprising an axis, with the rollers partially housed in the recessed area, the rollers arranged parallel to each other and perpendicular to the long axis of the first straight member; a second straight member having a first and second edge along the length of the second straight member, the first and second edges having a recess essentially the length of the second straight member, the second straight member fixedly attached to the first straight member such that the axes of the rollers of said first straight member are perpendicular to the length of the second straight member and the recessed area of the first straight member is oriented towards the second straight member, the second straight member also comprising one or more scales for measuring; a device for cutting and scoring, the device comprising a blade, the blade removably attached to a blade holder and/or slide, the blade holder and/or slide having tabs that extend into the concave recesses of the second straight member such that the blade holder and/or slide may slide essentially the length of the second straight member, and a means so that the blade may be moved towards and away from any sheet material being scored and cut.

In another embodiment, the present invention contemplates the T-square device of wherein the means for moving said blade towards and away from any sheet material being scored and cut comprises a pivot, a sliding or other suitable means.

In another embodiment, the present invention contemplates the T-square device of wherein the T-square device wherein the blade holder and/or slide is removable.

In another embodiment, the present invention contemplates the T-square device of wherein said blade holder can be secured to said second straight member.

In another embodiment, the present invention contemplates the T-square device of wherein the first straight member also comprises tabs or stabilizers that are attached to the first straight member, are perpendicular to the axes of the rollers of the first straight member and parallel to and inline with the length of the second straight member.

In another embodiment, the present invention contemplates the T-square device of wherein the tabs or stabilizers run the length of the first straight member.

In another embodiment, the present invention contemplates the T-square device of wherein the rollers are spaced about 1 inch apart form each other. In another embodiment, the present invention contemplates the T-square device of the rollers are spaced between 1 inch and 3 inches from each other.

In another embodiment, the present invention contemplates the T-square device of wherein said blade holder is replaced with a device for holding a writing utensil such as a pen, pencil or marker.

In another embodiment, the present invention contemplates the T-square device of wherein the device for holding a writing utensil holds the writing utensil at an angle of between 45 and 90 degrees as measured from the surface of the sheet material.

In another embodiment, the present invention contemplates the T-square device of wherein the blade holder can be secured to said second straight member.

In another embodiment, the present invention contemplates the T-square for aiding in the scoring and cutting of sheet material, comprising: a first straight member having essentially a "U" shape when viewed in cross section, said "U" shape giving the first member a recessed area, a plurality of rollers, each roller comprising an axis, with the rollers partially housed in the recessed area, the rollers arranged parallel to each other and perpendicular to the long axis of the first straight member and said rollers are between about 1 inch to 3 inches from each other, wherein the first straight member comprises stabilizers, the stabilizers being attached to the first straight member, are perpendicular to the axes of the rollers of the first straight member and parallel to and inline with the length of the second straight member; a second straight member having a first and second edge along the length of the second straight member, the first and second edges having a recess essentially the length of the second straight member, the second straight member fixedly attached to the first straight member such that the axes of the rollers of the first straight member are perpendicular to the length of said second straight member and the recessed area of said first straight member is oriented towards the second straight member, the second straight member also comprising one or more scales for measuring; a device for cutting and scoring, the device comprising a blade, the blade removably attached to a blade holder and/or slide, the blade holder and/or slide having tabs that extend into the concave recesses of the second straight member such that the blade holder and/or slide may slide essentially the length of the second straight member and wherein the blade holder or slide any be secured to the second straight member, and a means so that the blade may be moved towards and away from any sheet material being scored and cut and wherein said blade holder is replaceable with a device for holding writing utensils.

In another embodiment, the present invention contemplates the T-square device of wherein the device for holding a writing utensil holds the writing utensil at an angle of between 45 and 90 degrees as measured from the surface of the sheet material.

In another embodiment, the present invention contemplates the T-square device of wherein the tabs or stabilizers run the length of the first straight member.

Other features and advantages of the invention will be apparent from the following description.

DETAILED DESCRIPTION OF PREFERRED EMBODIMENTS

The invention will now be described in detail with reference to a few preferred embodiments, as illustrated in accompanying drawings. In the following description, numerous specific details are set forth in order to provide a thorough understanding of the invention. However, it will be apparent to one skilled in the art that the invention may be practiced without some or all of these specific details. In other instances, well-known features and/or process steps have not been described in detail in order to not unnecessarily obscure the invention. The features and advantages of the invention may be better understood with reference to the drawings and discussions that follow.

While the invention has been described with respect to a limited number of embodiments, those skilled in the art, having benefit of this disclosure, will appreciate that other embodiments can be devised which do not depart from the scope of the invention as disclosed herein.

Figure 1:
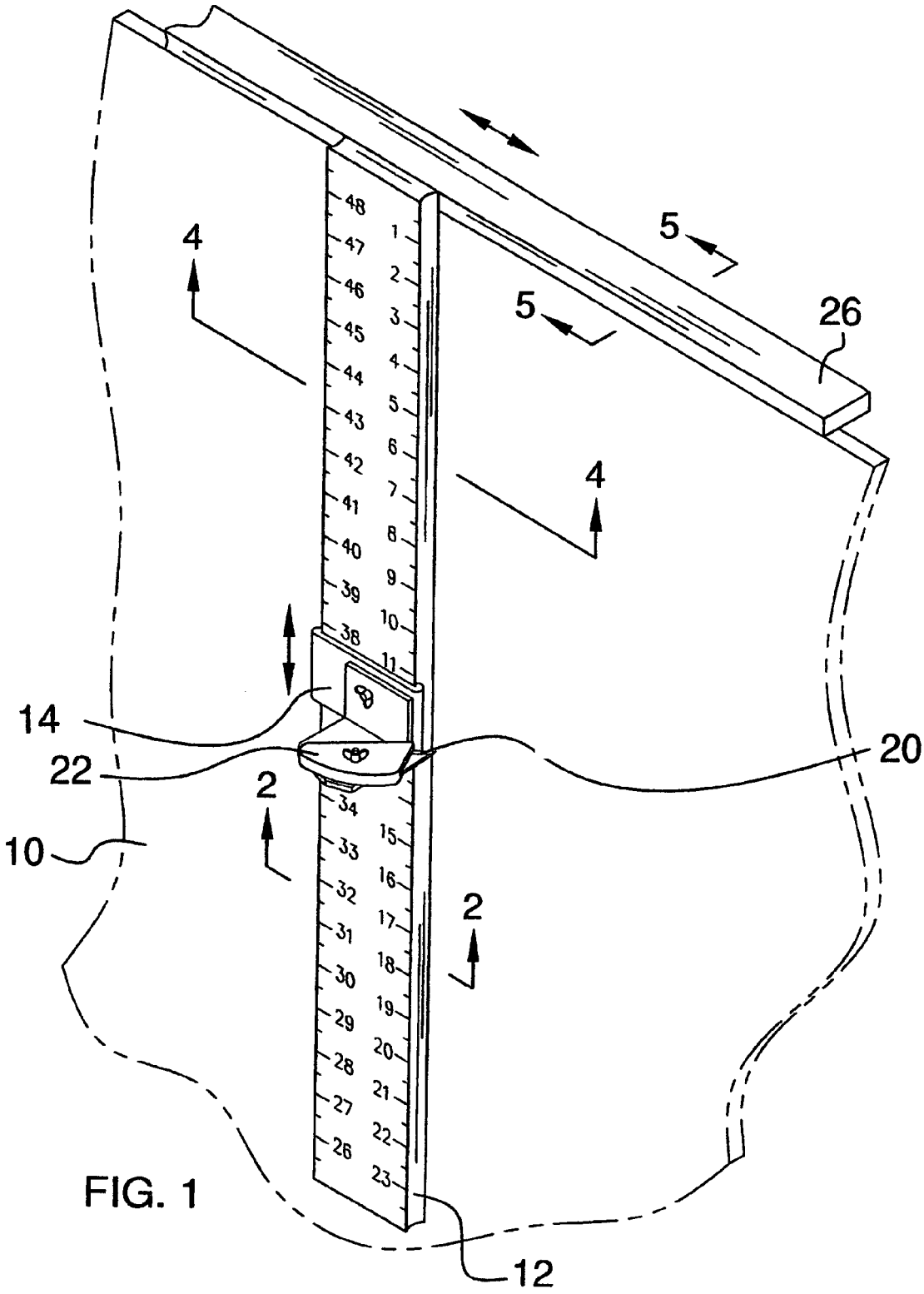
FIG. 1 shows one embodiment of a non-limiting view of the T-square device of the present invention.

Looking at FIG. 1, a piece of sheet material 10, (e.g., drywall) is positioned under the T-square device of the present invention. The first straight member 26 is positioned on the edge of the sheet material 10. The second straight member 12 is lying on the sheet material 10. The slide 14 is positioned on the second straight member 12. The blade holder 22 is attached to the slide 16 and holds a blade 20.

Figure 2:
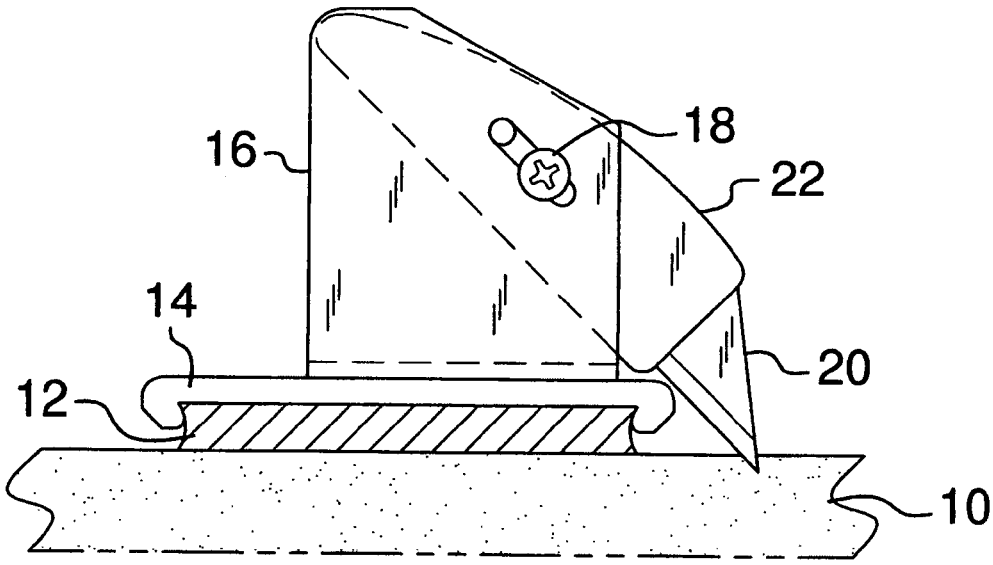
FIG. 2 shows one embodiment of a cross section of the second straight member of the present invention. In this non-limiting view, it can be seen how tabs of the slide of the blade holder fit into the recesses on the edges of the second straight member and how the blade holder and blade may be positioned for scoring and cutting sheet material.

FIG. 2 shows a cross section of the second straight member 12 at the location of the blade holding device. The second straight member 12 is resting on the drywall material 10. The slide 14 is positioned on the second straight member 12 with the tabs of the slide engaged in the recesses of the second straight member 12. Blade holder 16 holds blade handle 22 that, in turn, secures blade 20. Blade 20 and/or blade handle 22 are secured to blade holder 16 with screw 18.

Figure 3:
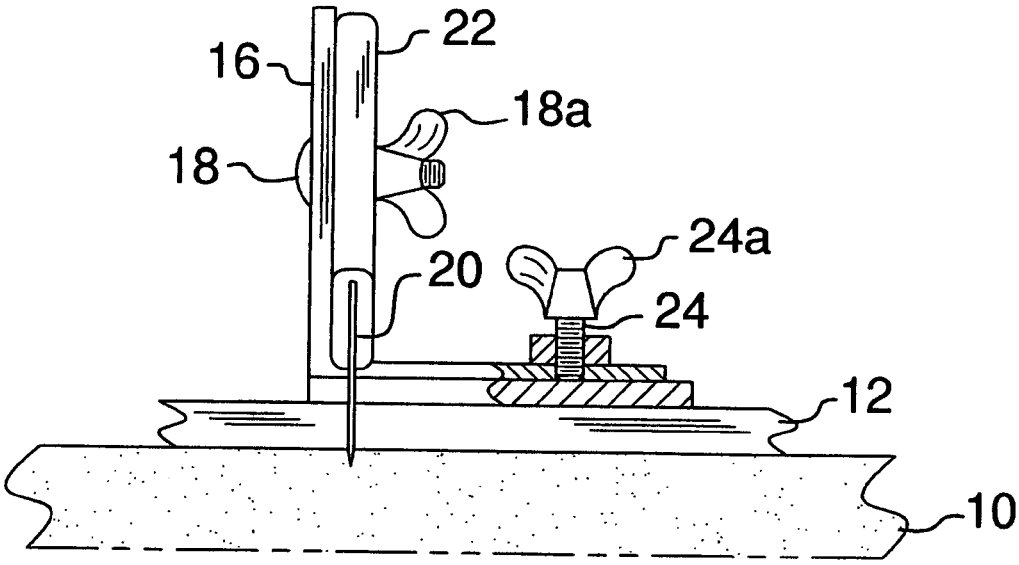
FIG. 3 shows one embodiment of an end on view of the blade, blade holder of the T-square device of the present invention.

FIG. 3 shows another view of the blade holding device of the present invention. Looking at FIG. 3, the second straight member 12 is resting on the drywall material 10. Blade holder 16 is mounted on slide (not numbered in this figure) with screw 24 and wing nut 24*a*. Blade handle 22 and blade 20 are secured to blade holder with screw 18 and wing nut 18*a*.

Figure 4A:
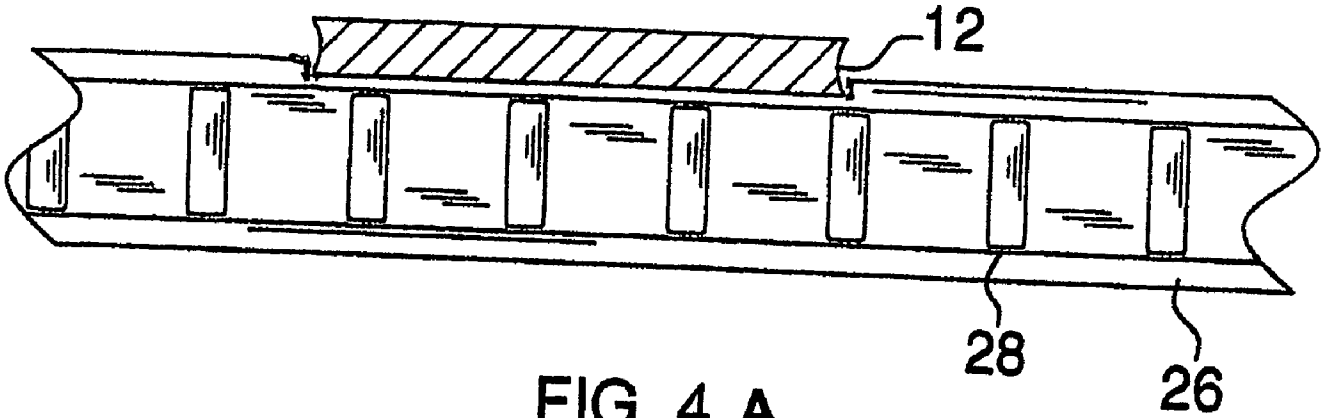
FIG. 4 shows two embodiments of how the second straight member of the present invention is positioned in relation to the first straight member of the present invention. (A) shows how the second straight member of the present invention may be recessed into the first straight member of the present invention. (B) shows how the second straight member of the present invention may be attached to the first straight member of the present invention without fitting into a recess on the first straight member of the present invention.
Figure 4B:
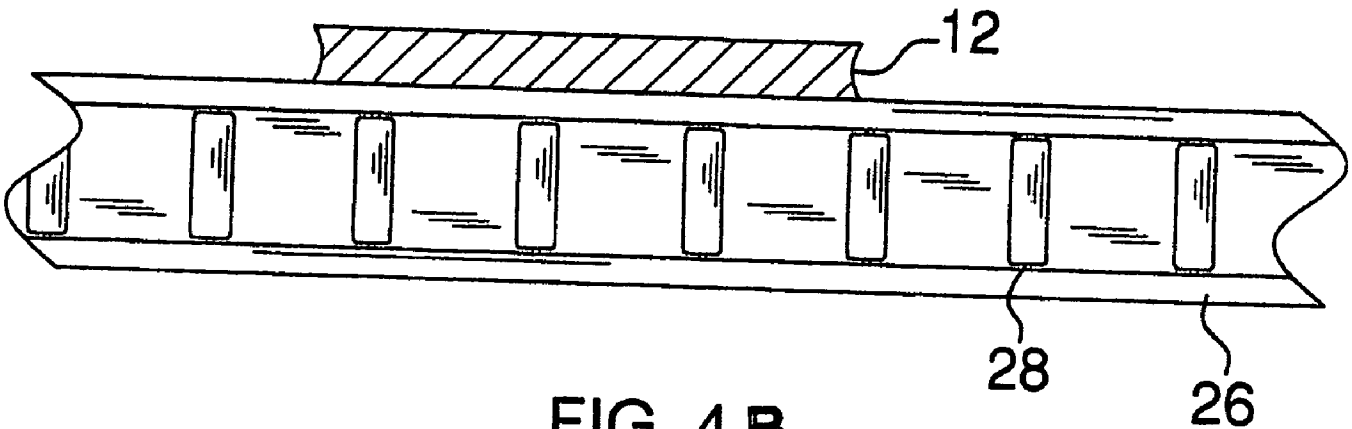

FIG. 4 shows two embodiments of how the second straight member 12 is positioned in relationship to the first straight member 26. In FIG. 4A, second straight member 12 is set into a recess in the first straight member 26. In FIG. 4B, second straight member 12 is positioned directly on top of the first straight member 26. In both FIGS. 4A and 4B the rollers 28 are visible.

Figure 5:
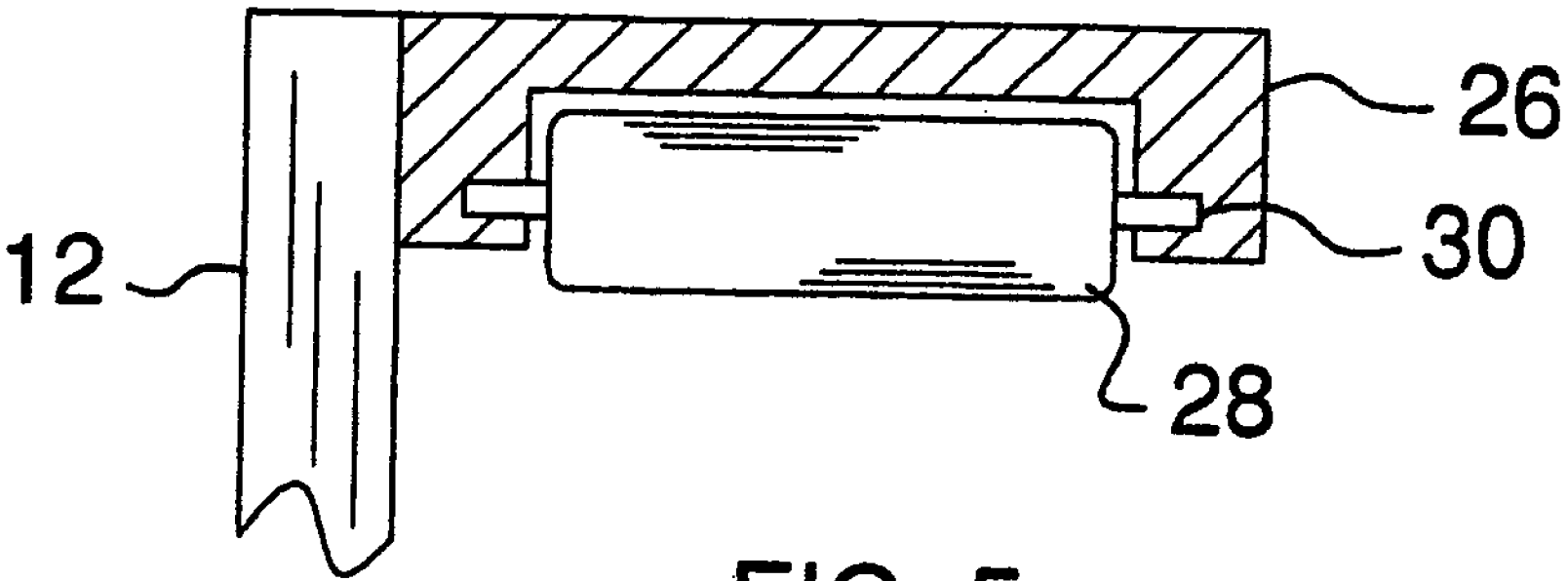
FIG. 5 shows one embodiment of how the rollers of the present invention are positioned in the first straight member of the present invention. It is also shown how the rollers extend beyond the edge of the first straight member of the present invention.

FIG. 5 shows one embodiment of how the rollers 28 of the present invention are positioned in the recess of the first straight member 26. Roller axle 30 is also visible as is a portion of the second straight member 12.

Figure 6:
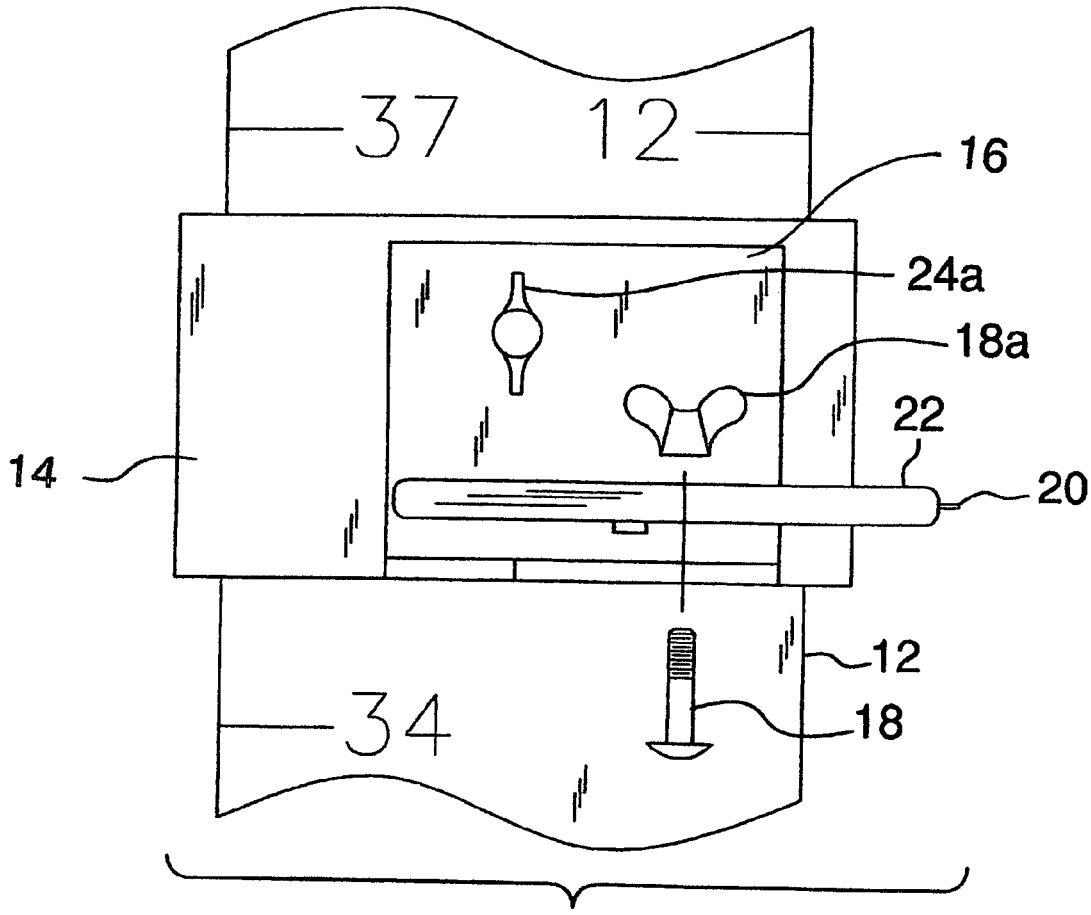
FIG. 6 shows one embodiment of how the blade and blade holder are attached to the slide of the present invention.

FIG. 6 shows a top view of the blade holder of the present invention. The second straight member 12 is shown with one embodiment of measuring marks (not numbered). Slide 14 is seen positioned over the second straight member. Blade holder 16 is positioned over slide 14. Wing nut 24*a* holds blade holder 16 on to slide 14. Screw 18 and wing nut 18*a* hold blade 20 and blade handle 22 onto blade holder 16.

What is claimed is:

1. A T-square device for aiding in the scoring and cutting of sheet material, comprising:

a. a first straight member having essentially a "U" shape when viewed in cross section, said "U" shape giving the first member a recessed area, a plurality of rollers, each roller comprising an axis, with said rollers partially housed in the recessed area, said rollers arranged parallel to each other and perpendicular to the long axis of said first straight member;

b. a second straight member having a first and second edge along the length of the second straight member, said first and second edges having a recess essentially the length of the second straight member, said second straight member fixedly attached to said first straight member such that the axes of said the rollers of said first straight member are perpendicular to the length of said second straight member and said recessed area of said first straight member is oriented towards said second straight member, said second straight member also comprising one or more scales for measuring;

c. a device for cutting and scoring, said device comprising a blade, said blade removably attached to a blade holder and/or slide, said blade holder and/or slide having tabs that extend into the concave recesses of said second straight member such that said blade holder and/or slide may slide essentially the length of said second straight member, and a means so that said blade may be moved towards and away from any sheet material being scored and cut.

2. The T-square device of claim 1, wherein said means for moving said blade towards and away from any sheet material being scored and cut comprises a pivot means.

3. The T-square device of claim 1, wherein said blade holder and/or slide is removable.

4. The T-square device of claim 1, wherein said blade holder can be secured to said second straight member.

5. The T-square device of claim 1, wherein said first straight member also comprises tabs or stabilizers that are attached to the first straight member, are perpendicular to the axes of the rollers of the first straight member and parallel to and inline with the length of the second straight member.

6. The T-square device of claim 5, wherein said tabs or stabilizers run the length of the first straight member.

7. The T-square device of claim 1, wherein said rollers are spaced about 1 inch apart form each other.

8. The T-square device of claim 1, wherein said rollers are spaced between 1 inch and 3 inches from each other.

9. The T-square device of claim 3, wherein said blade holder is replaced with a device for holding a writing utensil.

10. The T-square device of claim 9, wherein said blade holder can be secured to said second straight member.

11. The T-square of claim 9, wherein said device for holding a writing utensil holds the writing utensil at an angle of between 45 and 90 degrees as measured from the surface of the sheet material.

12. A T-square device for aiding in the scoring and cutting of sheet material, comprising:

a. a first straight member having essentially a "U" shape when viewed in cross section, said "U" shape giving the first member a recessed area, a plurality of rollers, each roller comprising an axis, with said rollers partially housed in the recessed area, said rollers arranged parallel to each other and perpendicular to the long axis of said first straight member and said rollers are between about 1 inch to 3 inches from each other, wherein said first straight member comprises stabilizers, said stabilizers being attached to the first straight member, are perpendicular to the axes of the rollers of the first straight member and parallel to and inline with the length of the second straight member;

b. a second straight member having a first and second edge along the length of the second straight member, said first and second edges having a recess essentially the length of the second straight member, said second straight member fixedly attached to said first straight member such that the axes of said the rollers of said first straight member are perpendicular to the length of said second straight member and said recessed area of said first straight member is oriented towards said second straight member, said second straight member also comprising one or more scales for measuring;

c. a device for cutting and scoring, said device comprising a blade, said blade removably attached to a blade holder and/or slide, said blade holder and/or slide having tabs that extend into the concave recesses of said second straight member such that said blade holder and/or slide may slide essentially the length of said second straight member and wherein said blade holder or slide any be secured to said second straight member, and a means so that said blade may be moved towards and away from any sheet material being scored and cut and wherein said blade holder is replaceable with a device for holding writing utensils.

13. The T-square of claim 12, wherein said device for holding a writing utensil holds the writing utensil at an angle of between 45 and 90 degrees as measured from the surface of the sheet material.

14. The T-square device of claim 12, wherein said tabs or stabilizers run the length of the first straight member.

* * * * *